US005668558A

United States Patent [19]

Hong

[11] Patent Number: 5,668,558

[45] Date of Patent: Sep. 16, 1997

[54] APPARATUS CAPABLE OF RECEIVING CIRCULARLY POLARIZED SIGNALS

[75] Inventor: Seong-Hun Hong, Seoul, Rep. of Korea

[73] Assignee: Daewoo Electronics Co., Ltd., Seoul, Rep. of Korea

[21] Appl. No.: 618,676

[22] Filed: Mar. 19, 1996

[30] Foreign Application Priority Data

Mar. 31, 1995 [KR] Rep. of Korea ..... 95-7345

[51] Int. Cl.[6] ..... H01Q 1/38

[52] U.S. Cl. ..... 343/700 MS; 343/846; 343/848; 343/858

[58] Field of Search ..... 343/700 MS, 846, 343/830, 848, 850, 852, 858; H01Q 1/38

[56] References Cited

U.S. PATENT DOCUMENTS 5,241,321 8/1993 Tsao ..... 343/700 MS 5,448,250 9/1995 Day ..... 343/700 MS 5,471,664 11/1995 Kim ..... 343/700 MS

*Primary Examiner*—Hoanganh T. Le

*Attorney, Agent, or Firm*—Anderson Kill & Olick P.C.

[57] ABSTRACT

An apparatus capable of receiving right-handed and left-handed circularly polarized signals for use in a parabolic reflector antenna comprises a first dielectric plate with a square shape, a square patch antenna prepared in a center of the first dielectric plate, a ground plate located under the first dielectric plate, a cross slot prepared in the ground plate, a second dielectric plate, a signal reception feedline prepared on a bottom surface of the second dielectric plate, a set of two output feedlines prepared on the bottom surface of the second dielectric plate, and a switching circuit enabling the signal reception feedline to receive either the right-handed circularly polarized signal or the left-handed circularly polarized signal. The inventive apparatus is smaller, cheaper, and easier to manufacture than conventional polarizers incorporated in parabolic reflector antennae.

2 Claims, 3 Drawing Sheets

APPARATUS CAPABLE OF RECEIVING CIRCULARLY POLARIZED SIGNALS

FIELD OF THE INVENTION

The present invention relates to a signal reception apparatus, and more particularly, to an apparatus capable of receiving right-handed and left-handed circularly polarized signals for use in a parabolic reflector antenna.

DESCRIPTION OF THE PRIOR ART

Reception of direct broadcast signals with, e.g., a 12 GHz carrier frequency from a satellite requires a circularly polarized antenna with a high gain and a low axial ratio. These requirements can be met with a conventional parabolic antenna equipped with a parabolic reflector, a circular feedhorn and a low noise block-down converter ("LNB").

Such parabolic antennae are also equipped with either an ortho-mode transducer ("OMT") or a polarizer installed between the feedhorn and the LNB. The OMT allows the parabolic antenna to simultaneously receive horizontally and vertically polarized signals. The polarizer also allows the antenna to receive said both signals, albeit not simultaneously. In addition, the OMT and the polarizer allow reception of circularly polarized signals.

After the circularly polarized signal has been broken down into vertically and horizontally polarized components by the feedhorn, the OMT or the polarizer separates out the horizontally polarized component from the vertical component, allowing each to be received individually. It should be noted that in this specification, unless otherwise defined or obvious from the context, directions, such as vertical or horizontal, are defined on a plane perpendicular to a direction from which the signals are incident, i.e., perpendicular to a line drawn from the antenna to the satellite.

The OMT and the polarizer discussed above are disclosed in, e.g., *The Satellite Book*, by John Breeds, Swift Television Publications, 1991. The OMT is formed by joining two waveguides together at a right angle, with a deflector vane installed at a junction of the two waveguides to separate the vertically and horizontally polarized signals. The vane directs the vertically polarized signals into one of the waveguides, while the horizontally polarized signals are received by the other waveguide. The polarizer is equipped with a resonant probe that is mechanically rotated. The vertically or the horizontally polarized signals can be received by changing an orientation of the resonant probe to match a direction of the polarization.

However, both the OMT and the polarizer are rather bulky, and if installed in front of the parabolic reflector, they may reduce the effectiveness of the parabolic antenna by obstructing significant portions of the parabolic reflector. In addition, the OMT and the polarizer are structurally complicated and difficult to manufacture, thus entailing increased unit costs.

SUMMARY OF THE INVENTION

It is, therefore, a primary object of the present invention to provide an economical and efficient apparatus capable of receiving right-handed and left-handed circularly polarized signals for use in a parabolic reflector antenna.

In accordance with a preferred embodiment of the present invention, there is provided an apparatus capable of receiving right-handed and left-handed circularly polarized signals for use in a parabolic reflector antenna, wherein said right-handed and left-handed directions are defined on a plane perpendicular to a direction from which the polarized signals are incident, i.e., perpendicular to a line drawn from the antenna to a satellite from which the polarized signals originate, and wherein the parabolic reflector antenna includes a feedhorn, the apparatus comprising: a first dielectric plate having a square shape; a square patch antenna, prepared in a center of the first dielectric plate and capable of receiving the right-handed and left-handed circularly polarized signals, each of its four sides having a length of $\lambda/2$, of which two sides are oriented in a vertical direction and two sides are oriented in a horizontal direction, wherein $\lambda$ is a wavelength of the right-handed and left-handed circularly polarized signals; a ground plate located under the first dielectric plate; a cross slot prepared on the ground plate, directly underneath and completely covered by the square patch antenna, formed by an intersection of a vertical slot and a horizontal slot, each having a length of $\lambda/2$ and being parallel to different sides of the square patch antenna, respectively, such that only the components of the signal parallel to the sides of the square patch antenna, i.e., horizontally and vertically polarized signal components, are allowed to pass through, wherein the horizontal and vertical directions are defined by the orientation of the square patch antenna; a second dielectric plate, located underneath the ground plate; a signal reception feedline capable of converting the horizontally and vertically polarized signal components received through the cross slot into corresponding electrical signals, located on a bottom surface of the second dielectric plate and provided with two output ends; a set of two output feedlines located on the bottom surface of the second dielectric plate, each of the output feedlines connected to one of the output ends of the signal reception feedline; and a switching circuit for enabling the signal reception feedline to output the electrical signal corresponding to either the right-handed circularly polarized signal or the left-handed circularly polarized signal.

BRIEF DESCRIPTION OF THE DRAWINGS

The above and other objects and features of the present invention will become apparent from the following description taken in conjunction with the accompanying drawings, in which.

DETAILED DESCRIPTION OF THE PREFERRED EMBODIMENTS

Figure 1:
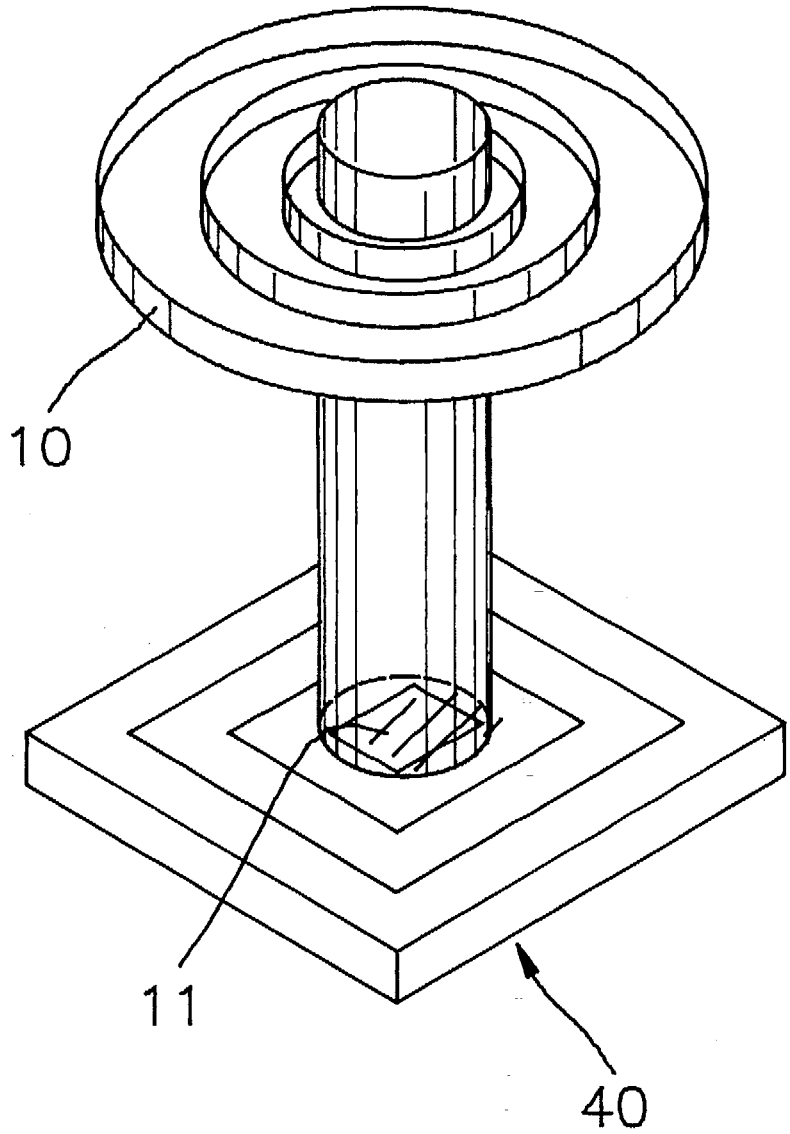
FIG. 1 presents a perspective view of the inventive apparatus coupled to a circular feedhorn.

Referring to FIG. 1, there is shown a perspective view of an inventive apparatus 40 for use in a parabolic reflector antenna (not shown), coupled to a circular feedhorn 10. The circular feedhorn 10, which collects radio signals focused onto it by a parabolic reflector (not shown), directs the radio signals thus collected onto a square patch antenna 11 incorporated into the apparatus 40.

Figure 2:
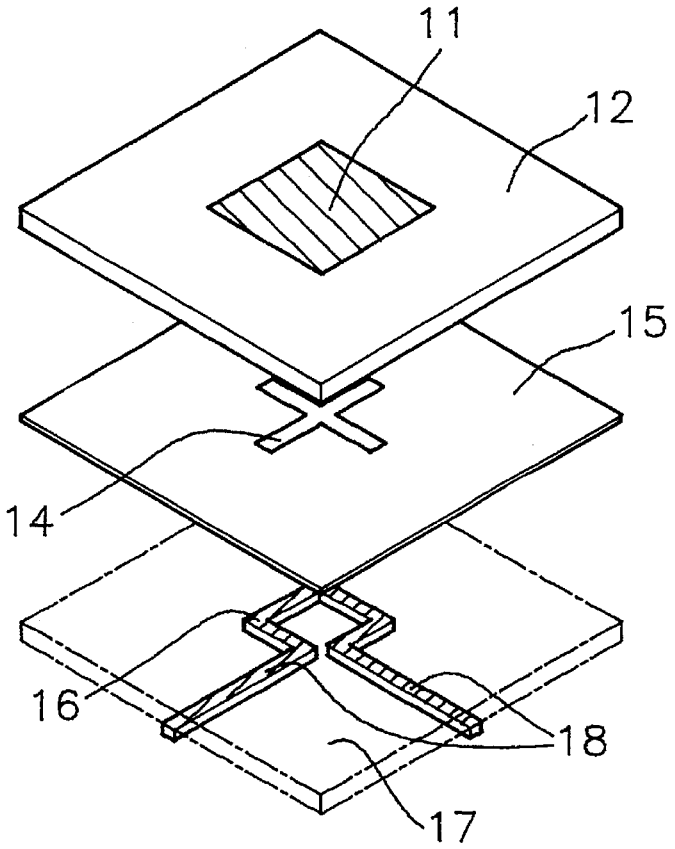
FIG. 2 shows an exploded perspective view of the inventive apparatus.

FIG. 2 presents an exploded perspective view of the inventive apparatus. The inventive apparatus comprises a first dielectric plate 12, in a center of which there is provided the square patch antenna 11, a ground plate 15 located beneath the first dielectric plate 12, a cross slot 14 formed by a vertical slot (not shown) and a horizontal slot (not shown) prepared in a center of the ground plate 15, a second dielectric plate 17 located beneath the ground plate 15, and a signal reception feedline 16 and two output feedlines 18 provided on a bottom surface (not shown) of the second dielectric plate 17. It should be noted that in this specification, unless otherwise defined or obvious from the context, directions, such as vertical, horizontal, left-handed circular, and right-handed circular, are defined on a plane perpendicular to an incident direction of the radio signals, i.e., perpendicular to a line drawn from the parabolic reflector antenna to a satellite that transmits the signals. In addition, it should be noted that in this specification, unless defined otherwise or obvious from the context, the vertical and horizontal directions are defined with respect to the sides of the square patch antenna 11.

The square patch antenna 11 is provided with two vertical sides (not shown) and two horizontal sides (not shown) all having a same length. The length of the sides of the square patch antenna 11 depends on a frequency of the signals that are intended to be received. In a preferred embodiment of the present invention, the sides of the square patch antenna are given a length of $\lambda/2$, wherein $\lambda$ is a wavelength of the signals that are intended to be received.

The vertical slot and the horizontal slot forming the cross slot 14 intersect perpendicularly with each other at their midpoints (not shown), and are oriented so that they are parallel to the vertical sides and the horizontal sides of the square patch antenna 11, respectively. The vertical slot and the horizontal slot have the same length as the sides of the square patch antenna 11. In addition, the cross slot 14 is positioned so that its center, i.e., a point where the vertical slot and the horizontal slot intersect, is directly beneath a center of the square patch antenna 11. Thus, the cross slot 14 is positioned so that it is entirely covered by the square patch antenna 11.

Figure 3:
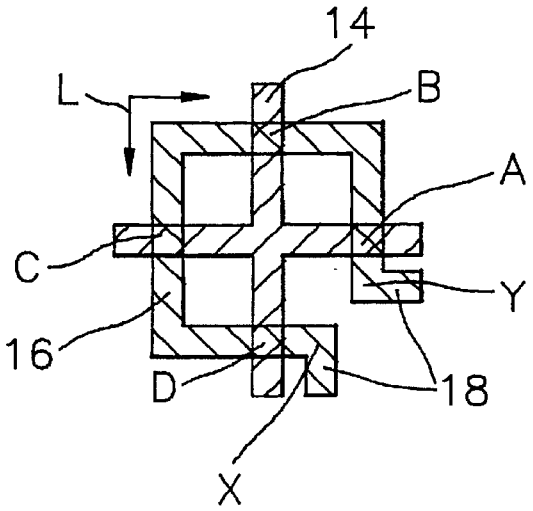
FIG. 3 illustrates a schematic diagram of a cross slot, a signal reception feedline, and an output feedline incorporated in the inventive apparatus.

The signal reception feedline 16 and the two output feedlines 18 are prepared on the bottom surface of the second dielectric plate 17. As shown in FIG. 3, the signal reception feedline 16 forms an open cornered square, consisting of two long sections (not shown) and two short sections (not shown). The length of the long sections depends on the frequency of the signals intended to be received. In the preferred embodiment of the present invention, each of the long sections is given a length of $\lambda/4$.

Each of the two short sections is connected by one end to one of the two long sections. The other (i.e., unjoined) ends of the short sections constitute two output ends X, Y. The two short sections have a same length, subject to the condition that they be longer than half of the length of the long sections.

The signal reception feedline 16 is positioned such that a center of the open cornered square formed by the long sections and the short sections is directly beneath the center of the cross slot 14. As can be seen from FIG. 3, one of the long sections and one of the short sections are perpendicular to the vertical slot of the cross slot 14, while the remaining long section and the remaining short section are perpendicular to the horizontal slot of the cross slot 14. Thus, if the cross slot 14 is superimposed over the signal reception feedline 16, as shown in FIG. 3, they will intersect at points A, B, C and D, which represent points of the signal reception feedline 16 that are located directly underneath the cross slot 14.

It should be noted that the points A, B, C and D divide the signal reception feedline 16 into three portions of an equal length. In the inventive apparatus, the length L of each of the three portions, i.e., the portion of the signal reception feedline 16 from point A to point B, from point B to point C, or from point C to point D, is equal to $\lambda/4$. Thus, the points of the signal reception feedline 16—that are located directly underneath the cross slot 14 and consequently can interact with signals which come through the cross slot 14—are evenly spaced along the signal reception feedline 16.

Figure 4:
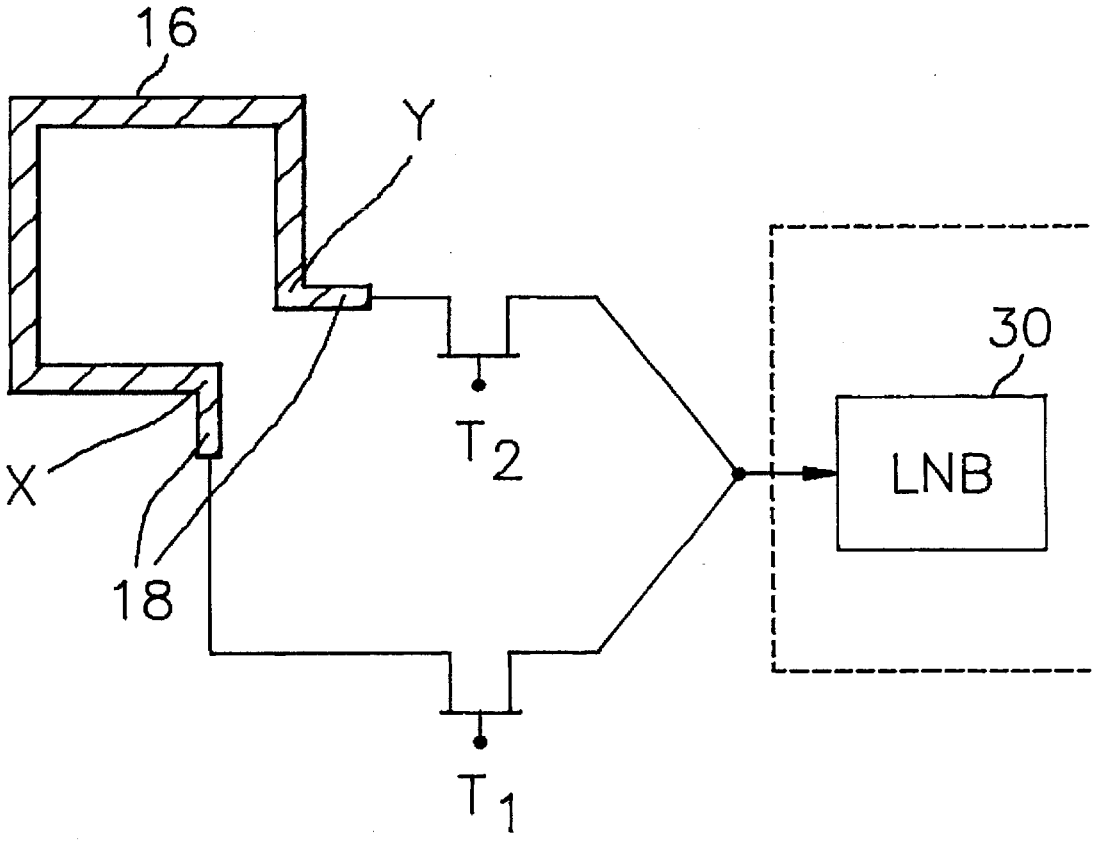
FIG. 4 offers a schematic diagram of the signal reception feedline, the output feedline, and a switching circuitry incorporated in the inventive apparatus.

As mentioned above, the output feedlines 18 are each connected to one of the output ends X, Y of the signal reception feedline 16. The output feedlines 18 are identical in length, and are each connected in turn to a source pin (not shown) of one of two metal-semiconductor field effect transistors ("MESFET") $T_1$, $T_2$, as shown in FIG. 4. Thus, one of the output feedlines 18 provides an electrically conductive path from the output end X to the source pin of a first MESFET $T_1$ while the remaining output feedline 18 provides an electrically conductive path from the output end Y to the source pin of a second MESFET $T_2$.

Each of the MESFETs $T_1$, $T_2$ is also equipped with a drain pin (not shown) and a gate pin (not shown). The drain pins of the MESFETs $T_1$, $T_2$ are connected to a low noise block-down converter ("LNB") 30 provided in the parabolic reflector antenna. The gate pins provide a way to control the MESFETs $T_1$, $T_2$. Depending on a voltage applied to its gate pin, a MESFET can behave as a closed switch, allowing a current to run from its source pin to its drain pin, or as an open switch, effectively stopping any electrical signal received through the source pin from reaching the drain pin. Thus, by applying appropriate voltages to the MESFETs $T_1$, $T_2$, electrical signals can be permitted to reach, or restrained from reaching, the LNB 30 from the output ends X, Y, respectively.

The signal reception apparatus described above is capable of receiving signals polarized in a right-handed or left-handed circular direction. The signals are first focused onto the feedhorn 10 by the parabolic reflector. The feedhorn 10 then directs the signals it collects onto the signal reception apparatus, where the cross slot 14 allows the vertically and horizontally polarized components of the collected signals to pass through the ground plate 15. The vertically and horizontally polarized components are then received by the signal reception feedline 17 and converted into electrical signals, which are outputted to the LNB 30 via the output feedlines 18 and the MESFETs $T_1$, $T_2$.

In the inventive apparatus, the right-handed circularly or left-handed circularly polarized signals can be selected for reception by applying an appropriate voltage to the gate pins of the MESFETs $T_1$, $T_2$. In case n-type MESFETs are used, the flow of currents through the MESFETs, i.e., from the source pin to the drain pin, can be permitted or restricted by applying a predetermined negative voltage or a zero voltage, respectively, to the gate pin. As can be seen from FIG. 4, restricting the flow of current through the second MESFET $T_2$, while allowing current to flow through the first MESFET $T_1$, results in a left-handed conducting loop capable of receiving the left-handed circularly polarized signals, formed by the signal reception feedline 16, the first MESFET $T_1$, and the output feedline 18 between them. Similarly, restricting the flow of current through the first MESFET $T_1$, while allowing current to flow through the second MESFET $T_2$ results in a right-handed conducting loop capable of receiving right-handed circularly polarized signals.

Thus, the invention provides an apparatus which is smaller, cheaper, and easier to manufacture than conventional polarizers incorporated in parabolic reflector antennae for receiving left-handed and right-handed circularly polarized signals.

While the present invention has been shown and described above with respect to the particular embodiments, it will be apparent to those skilled in the art that many changes, alterations and modifications may be made without departing from the spirit and scope of the invention as defined in the appended claims.

What is claimed is:

1. An apparatus capable of receiving right-handed and left-handed circularly polarized signals for use in a parabolic reflector antenna, wherein said right-handed and left-handed directions are defined on a plane perpendicular to a direction from which the polarized signals are incident, and wherein the parabolic reflector antenna includes a feedhorn, the apparatus comprising:

a first dielectric plate having a square shape;

a square patch antenna, prepared in a center of the first dielectric plate, capable of receiving the right-handed and left-handed circularly polarized signals, and provided with two sides oriented in a vertical direction and two sides oriented in a horizontal direction, each of its sides having a length of $\lambda/2$, wherein $\lambda$ is a wavelength of the right-handed and left-handed circularly polarized signals;

a ground plate located under the first dielectric plate;

a cross slot prepared on the ground plate, directly underneath and completely covered by the square patch antenna, formed by an intersection of a vertical slot and a horizontal slot, each having a length of $\lambda/2$ and being parallel to different sides of the square patch antenna, respectively, such that only horizontally and vertically polarized signal components are allowed to pass through the cross slot, wherein the horizontal and vertical directions are defined by the orientation of the square patch antenna;

a second dielectric plate, located underneath the ground plate;

a signal reception feedline capable of converting the horizontally and vertically polarized signal components received through the cross slot into corresponding electrical signals, located on a bottom surface of the second dielectric plate and provided with two output ends, wherein the signal reception feedline is composed of two long sections and two short sections joined together to form an open-cornered square directly underneath the cross slot, with the unjoined ends of the two short sections forming the output ends, a center of the open-cornered square located directly beneath a center of the cross slot, the two long and short sections being parallel to the sides of the square patch antenna, and the two long sections having a length of $\lambda/4$ and the two short sections having a length longer than $\lambda/8$;

a set of two output feedlines located on the bottom surface of the second dielectric plate, each of the output feedlines connecting to one of the output ends of the signal reception feedline; and a switching circuit for enabling the signal reception feedline to output the electrical signal corresponding to either the right-handed circularly polarized signal or the left-handed circularly polarized signal, electrically connecting the two output feedlines to a low noise block-down converter.

2. The apparatus of claim 1, wherein the switching circuit includes two metal-semiconductor field effect transistors, a source pin of each transistor being connected to one of the output feedlines, and a drain pin of said each transistor being connected to the low noise block-down converter.

* * * * *